US011584134B2

(12) United States Patent
Shimoyama et al.

(10) Patent No.: US 11,584,134 B2
(45) Date of Patent: Feb. 21, 2023

(54) PRINT HEAD AND PRINTING APPARATUS

(71) Applicant: CANON KABUSHIKI KAISHA, Tokyo (JP)

(72) Inventors: Noboru Shimoyama, Yokohama (JP); Soji Kondo, Yokohama (JP); Akira Kida, Yokohama (JP); Tetsuji Kurata, Yokohama (JP); Atsushi Kohnotoh, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/062,120

(22) Filed: Oct. 2, 2020

(65) Prior Publication Data

US 2021/0016574 A1 Jan. 21, 2021

Related U.S. Application Data

(63) Continuation of application No. 16/361,664, filed on Mar. 22, 2019, now Pat. No. 10,814,637.

(30) Foreign Application Priority Data

Mar. 29, 2018 (JP) ..... JP2018-065463
Mar. 29, 2018 (JP) ..... JP2018-065475

(51) Int. Cl.
*B41J 2/175* (2006.01)
*B41J 2/155* (2006.01)

(52) U.S. Cl.
CPC ..... *B41J 2/17523* (2013.01); *B41J 2/155* (2013.01); *B41J 2/17553* (2013.01)

(58) Field of Classification Search
CPC .... B41J 2/175; B41J 2/17506; B41J 2/17509; B41J 2/17513; B41J 2/17523; B41J 2/18
See application file for complete search history.

(56) References Cited

U.S. PATENT DOCUMENTS 5,631,681 A * 5/1997 Klaus ..... B41J 2/17509 347/85
6,089,687 A * 7/2000 Helterline ..... B41J 2/17546 347/7
6,116,719 A 9/2000 Maza
6,244,698 B1 6/2001 Chino et al.
6,460,984 B1 10/2002 Matsumoto et al.
(Continued)

FOREIGN PATENT DOCUMENTS

EP 0445526 * 2/1991 ..... B41J 2/165
JP 2003-311999 A 11/2003
(Continued)

OTHER PUBLICATIONS

Office Action dated Feb. 15, 2022, in Japanese Patent Application No. 2018-065475.
(Continued)

*Primary Examiner* — Anh T Vo
(74) *Attorney, Agent, or Firm* — Venable LLP

(57) ABSTRACT

A print head can suppress contamination due to ink at the time of being mounted on a printing apparatus and/or after being detached from the printing apparatus. For this purpose, a positioning pin longer than a needle is provided in a joint unit of the print head, and the joint unit includes a shutter which closes an opening on a supply side and an opening on a collection side when the print head is detached.

11 Claims, 12 Drawing Sheets

(56) References Cited

U.S. PATENT DOCUMENTS

| | | | | |
|---|---|---|---|---|
| 6,488,369 | B1 * | 12/2002 | Steinmetz | B41J 2/1752 347/86 |
| 7,862,142 | B2 * | 1/2011 | Taira | B41J 2/1707 347/20 |
| 8,210,666 | B2 | 7/2012 | Hirashima | |
| 8,454,140 | B2 | 6/2013 | Kondo | |
| 8,480,214 | B2 | 7/2013 | Tsubaki | |
| 8,752,946 | B2 | 6/2014 | Wells, Jr. et al. | |
| 8,919,925 | B2 | 12/2014 | Maeshima et al. | |
| 9,114,624 | B2 | 8/2015 | Yamamoto et al. | |
| 9,962,945 | B2 | 5/2018 | Takaoka et al. | |
| 2009/0141084 | A1 | 6/2009 | Kim et al. | |
| 2016/0207321 | A1 | 7/2016 | Osakabe | |
| 2016/0264306 | A1 | 9/2016 | Nishimaki et al. | |
| 2018/0126743 | A1 | 5/2018 | Moriyama et al. | |
| 2018/0244052 | A1 | 8/2018 | Okumura et al. | |
| 2019/0001690 | A1 | 1/2019 | Nagai et al. | |
| 2019/0009541 | A1 | 1/2019 | Kondo et al. | |

FOREIGN PATENT DOCUMENTS

| | | | |
|---|---|---|---|
| JP | 2008-074050 | A | 4/2008 |
| JP | 2010-030206 | A | 2/2010 |
| JP | 2011-240520 | A | 12/2011 |
| JP | 2013-173252 | A | 9/2013 |
| JP | 2014-008672 | A | 1/2014 |
| JP | 2017-047547 | A | 3/2017 |
| JP | 2017-081083 | A | 5/2017 |

OTHER PUBLICATIONS

Office Action dated Feb. 22, 2022, in Japanese Patent Application No. 2018-065463.

* cited by examiner

PRINT HEAD AND PRINTING APPARATUS

BACKGROUND OF THE INVENTION

Field of the Invention

The present invention relates to a print head used in a printing apparatus which prints by ejecting ink, the print head being provided with a joint unit to which ink is supplied and to a printing apparatus which prints using the print head.

Description of the Related Art

In a printing apparatus which prints by ejecting liquid (ink) from a print head, there is known a print head detachable with respect to the printing apparatus. In such a print head, because ink stored in a tank is supplied to the print head through a flow path, there is provided a joint unit configured to connect the flow path and the print head. In connecting the flow path and the print head provided with the joint unit, accurate connection is required so as not to cause leakage of ink in the connection unit.

Japanese Patent Laid-Open No. 2011-240520 describes a print head including an ink supply unit provided with an opening for supplying ink. Here, an ink joint pipe is connected to the opening of the ink supply unit, so that the ink stored in an ink tank is supplied to the print head through the ink supply unit.

However, the opening of the ink supply unit according to Japanese Patent Laid-Open No. 2011-240520 is exposed to the outside, so when the print head and the ink supply unit are detached from the apparatus, ink might leak from the opening. Moreover, Japanese Patent Laid-Open No. 2011-240520 does not refer to a satisfactory connection method not causing leakage of ink in the opening where connection is made.

SUMMARY OF THE INVENTION

Accordingly, the present invention provides a print head which suppresses contamination due to ink at the time of being mounted on a printing apparatus and/or after being detached from the printing apparatus, and a printing apparatus which prints using the print head.

A printing apparatus of the present invention can comprise a print head including a supply port to be supplied with ink and an ejection port for ejecting ink supplied from the supply port, the print head being detachable to the printing apparatus; and a shutter which moves from a covering position, at which the supply port is covered, to an exposing position, at which the supply port is exposed, by mounting the print head on the apparatus.

According to the present invention, a print head which suppresses contamination due to ink at the time of being mounted on a printing apparatus and/or after being detached from the printing apparatus, and a printing apparatus for printing using the print head can be realized.

Further features of the present invention will become apparent from the following description of exemplary embodiments with reference to the attached drawings.

DESCRIPTION OF THE EMBODIMENTS

Hereinafter, embodiments of the present invention will be described with reference to the accompanying drawings.

Figure 1:
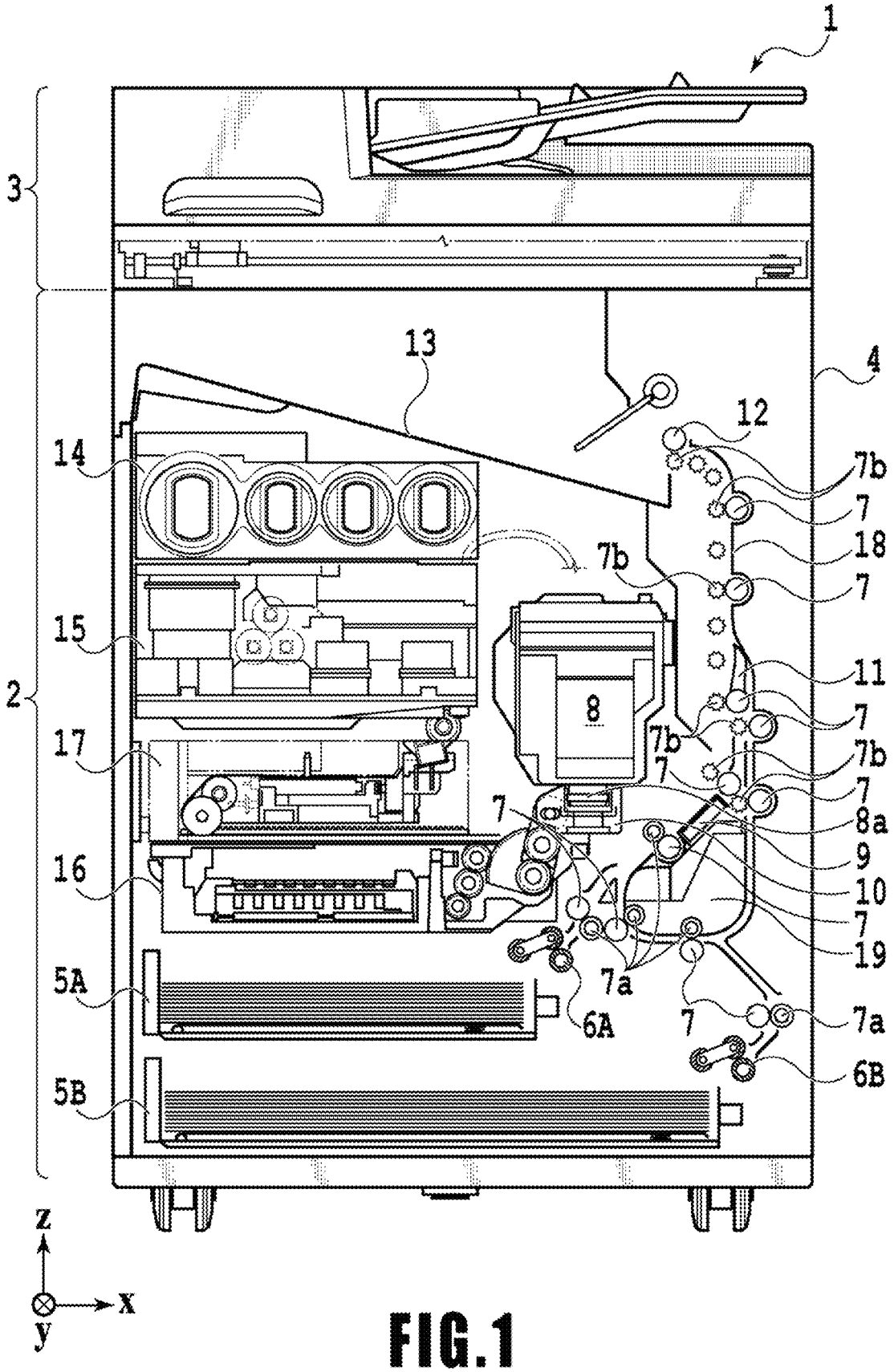
FIG. 1 shows an internal configuration of an inkjet printing apparatus.

FIG. 1 is an internal configuration diagram of an inkjet printing apparatus 1 (hereinafter "printing apparatus 1") used in the present embodiment. In the drawings, an x-direction is a horizontal direction, a y-direction (a direction perpendicular to paper) is a direction in which ejection openings are arrayed in a print head 8 described later, and a z-direction is a vertical direction.

The printing apparatus 1 is a multifunction printer comprising a print unit 2 and a scanner unit 3. The printing apparatus 1 can use the print unit 2 and the scanner unit 3 separately or in synchronization to perform various processes related to print operation and scan operation. The scanner unit 3 comprises an automatic document feeder (ADF) and a flatbed scanner (FBS) and is capable of scanning a document automatically fed by the ADF as well as scanning a document placed by a user on a document plate of the FBS. The present embodiment is directed to the multifunction printer comprising both the print unit 2 and the scanner unit 3, but the scanner unit 3 may be omitted.

FIG. 1 shows the printing apparatus 1 in a standby state in which neither print operation nor scan operation is performed.

In the print unit 2, a first cassette 5A and a second cassette 5B for housing printing media (cut sheets) S are detachably provided at the bottom of a casing 4 in the vertical direction. Relatively small printing media of up to A4 size are stacked and housed in the first cassette 5A and relatively large printing medium of up to A3 size are stacked and housed in the second cassette 5B. A first feeding unit 6A for feeding housed printing medium one by one is provided near the first cassette 5A. Similarly, a second feeding unit 6B is provided near the second cassette 5B. In print operation, a print medium S is selectively fed from either one of the cassettes.

Conveying rollers 7, a discharging roller 12, pinch rollers 7*a*, spurs 7*b*, a guide 18, an inner guide 19, and a flapper 11 are conveying mechanisms for guiding a print medium S in a predetermined direction. The conveying rollers 7 are drive rollers located upstream and downstream of the print head 8 (platen 9) and driven by a conveying motor (not shown). The pinch rollers 7*a* are follower rollers that are turned while nipping a print medium S together with the conveying rollers 7. The discharging roller 12 is a drive roller located downstream of the conveying rollers 7 and driven by the conveying motor (not shown). The spurs 7*b* nip and convey a print medium S together with the conveying rollers 7 and discharging roller 12 located downstream of the print head 8 (platen 9).

The printing apparatus 1 has multiple motors for driving the above drive rollers, and each drive roller is connected to one of the motors. The relationship between the motors and the drive roller will be described later in detail.

The guide 18 is provided in a conveying path of a print medium S to guide the print medium S in a predetermined direction. The inner guide 19 is a member extending in the y-direction. The inner guide 19 has a curved side surface and guides a print medium S along the side surface. The flapper 11 is a member for changing a direction in which a print medium S is conveyed in duplex print operation. A discharging tray 13 is a tray for stacking and housing printing media S that were subjected to print operation and discharged by the discharging roller 12.

The print head 8 of the present embodiment is a full line type color inkjet print head. In the print head 8, a plurality of ejection openings configured to eject ink based on print data are arrayed in the y-direction in FIG. 1 so as to correspond to the width of a print medium S. That is, the print head is configured to eject inks of a plurality of colors. When the print head 8 is in a standby position, an ejection opening surface 8*a* of the print head 8 is oriented vertically downward and capped with a cap unit 10 as shown in FIG. 1. In print operation, the orientation of the print head 8 is changed by a print controller 202 described later such that the ejection opening surface 8*a* faces a platen 9. The platen 9 includes a flat plate extending in the y-direction and supports a print medium S being subjected to print operation by the print head 8 from the back side. The movement of the print head 8 from the standby position to a printing position will be described later in detail.

An ink tank unit 14 separately stores ink of four colors to be supplied to the print head 8. An ink supply unit 15 is provided in the midstream of a flow path connecting the ink tank unit 14 to the print head 8 to adjust the pressure and flow rate of ink in the print head 8 within a suitable range. The present embodiment adopts a circulation type ink supply system, where the ink supply unit 15 adjusts the pressure of ink supplied to the print head 8 and the flow rate of ink collected from the print head 8 within a suitable range.

A maintenance unit 16 comprises the cap unit 10 and a wiping unit 17 and activates them at predetermined timings to perform maintenance operation for the print head 8. The maintenance operation will be described later in detail.

Figure 2:
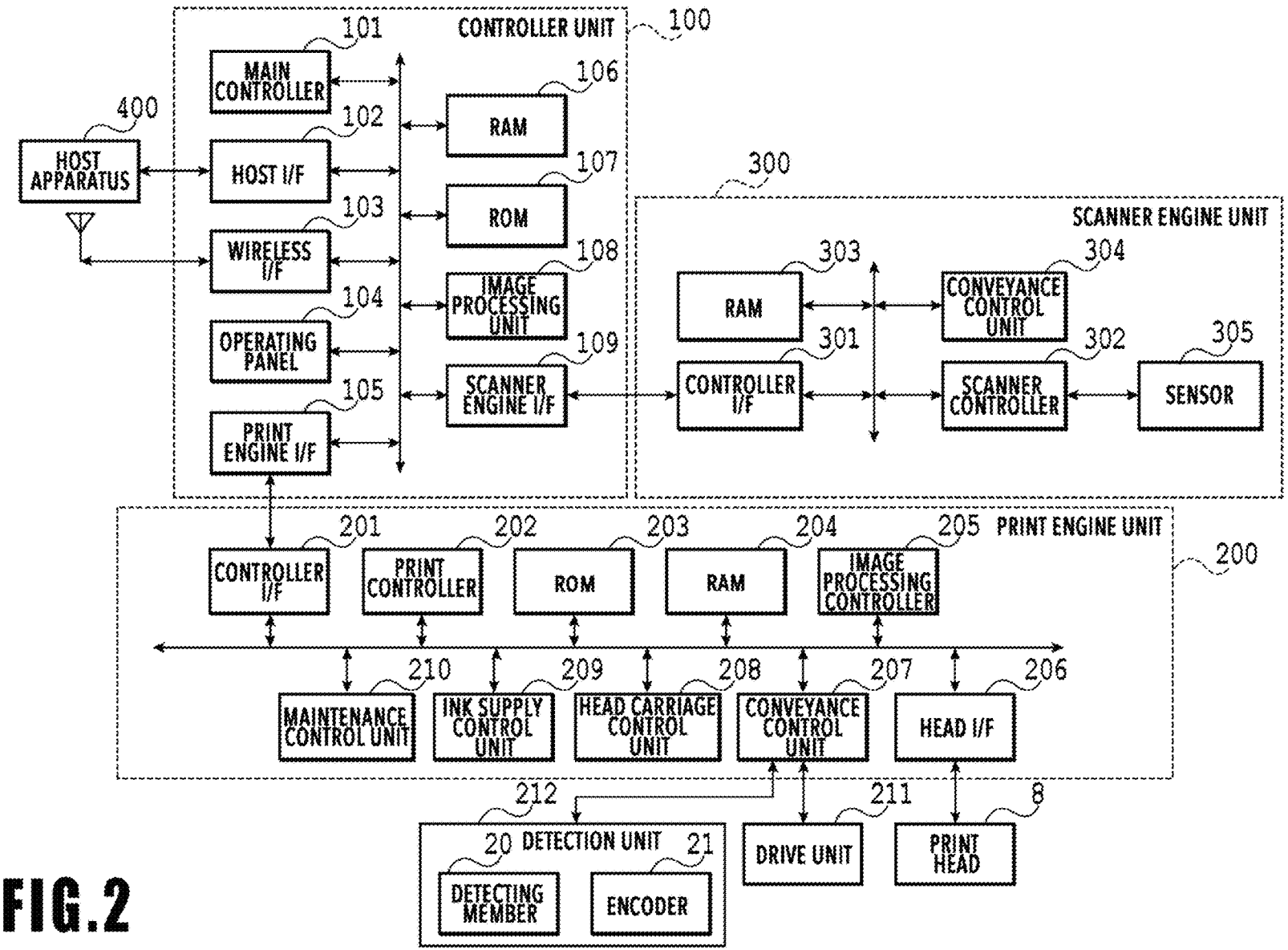
FIG. 2 is a block diagram showing a control configuration in the printing apparatus.

FIG. 2 is a block diagram showing a control configuration in the printing apparatus 1. The control configuration mainly includes a print engine unit 200 that exercises control over the print unit 2, a scanner engine unit 300 that exercises control over the scanner unit 3, and a controller unit 100 that exercises control over the entire printing apparatus 1. A print controller 202 controls various mechanisms of the print engine unit 200 under instructions from a main controller 101 of the controller unit 100. Various mechanisms of the scanner engine unit 300 are controlled by the main controller 101 of the controller unit 100. The control configuration will be described below in detail.

In the controller unit 100, the main controller 101 including a CPU controls the entire printing apparatus 1 using a RAM 106 as a work area in accordance with various parameters and programs stored in a ROM 107. For example, when a print job is input from a host apparatus 400 via a host I/F 102 or a wireless I/F 103, an image processing unit 108 executes predetermined image processing for received image data under instructions from the main controller 101. The main controller 101 transmits the image data subjected to the image processing to the print engine unit 200 via a print engine I/F 105.

The printing apparatus 1 may acquire image data from the host apparatus 400 via a wireless or wired communication or acquire image data from an external storage unit (such as a USB memory) connected to the printing apparatus 1. A communication system used for the wireless or wired communication is not limited. For example, as a communication system for the wireless communication, Wi-Fi (Wireless Fidelity; registered trademark) and Bluetooth (registered trademark) can be used. As a communication system for the wired communication, a USB (Universal Serial Bus) and the like can be used. For example, when a scan command is input from the host apparatus 400, the main controller 101 transmits the command to the scanner unit 3 via a scanner engine I/F 109.

An operating panel 104 is a mechanism to allow a user to perform input and output for the printing apparatus 1. A user can give an instruction to perform operation such as copying and scanning, set a print mode, and recognize information about the printing apparatus 1 via the operating panel 104.

In the print engine unit 200, the print controller 202 including a CPU controls various mechanisms of the print unit 2 using a RAM 204 as a work area in accordance with various parameters and programs stored in a ROM 203. When various commands and image data are received via a controller I/F 201, the print controller 202 temporarily stores them in the RAM 204. The print controller 202 allows an image processing controller 205 to convert the stored image data into print data such that the print head 8 can use it for print operation. After the generation of the print data, the print controller 202 allows the print head 8 to perform print operation based on the print data via a head I/F 206. At this time, the print controller 202 conveys a print medium S by driving the feeding units 6A and 6B, conveying rollers 7, discharging roller 12, and flapper 11 shown in FIG. 1 via a conveyance control unit 207. The print head 8 performs print operation in synchronization with the conveyance operation of the print medium S under instructions from the print controller 202, thereby performing printing.

The conveyance control unit 207, connected to the detection unit 212 for detecting the conveyance state of the printing medium S and the drive unit 211 for driving the drive rollers, controls the conveyance of the printing medium S using the drive unit 211, based on detection results obtained from the detection unit 212. The detection unit 212 has the detection members 20 for detecting the printing medium S and the encoders 21 for detecting the amount of rotation of the drive rollers.

Printing is performed in the course of the conveyance of the printing medium S by the conveyance control unit 207, by the print head 8 performing print operation under instructions from the print controller 202.

A head carriage control unit 208 changes the orientation and position of the print head 8 in accordance with an operating state of the printing apparatus 1 such as a maintenance state or a printing state. An ink supply control unit 209 controls the ink supply unit 15 such that the pressure of ink supplied to the print head 8 is within a suitable range. A maintenance control unit 210 controls the operation of the cap unit 10 and wiping unit 17 in the maintenance unit 16 when performing maintenance operation for the print head 8.

In the scanner engine unit 300, the main controller 101 controls hardware resources of the scanner controller 302 using the RAM 106 as a work area in accordance with various parameters and programs stored in the ROM 107, thereby controlling various mechanisms of the scanner unit 3.

For example, the main controller 101 controls hardware resources in the scanner controller 302 via a controller I/F 301 to cause a conveyance control unit 304 to convey a document placed by a user on the ADF and cause a sensor 305 to scan the document. The scanner controller 302 stores scanned image data in a RAM 303. The print controller 202 can convert the image data acquired as described above into print data to enable the print head 8 to perform print operation based on the image data scanned by the scanner controller 302.

Figure 3:
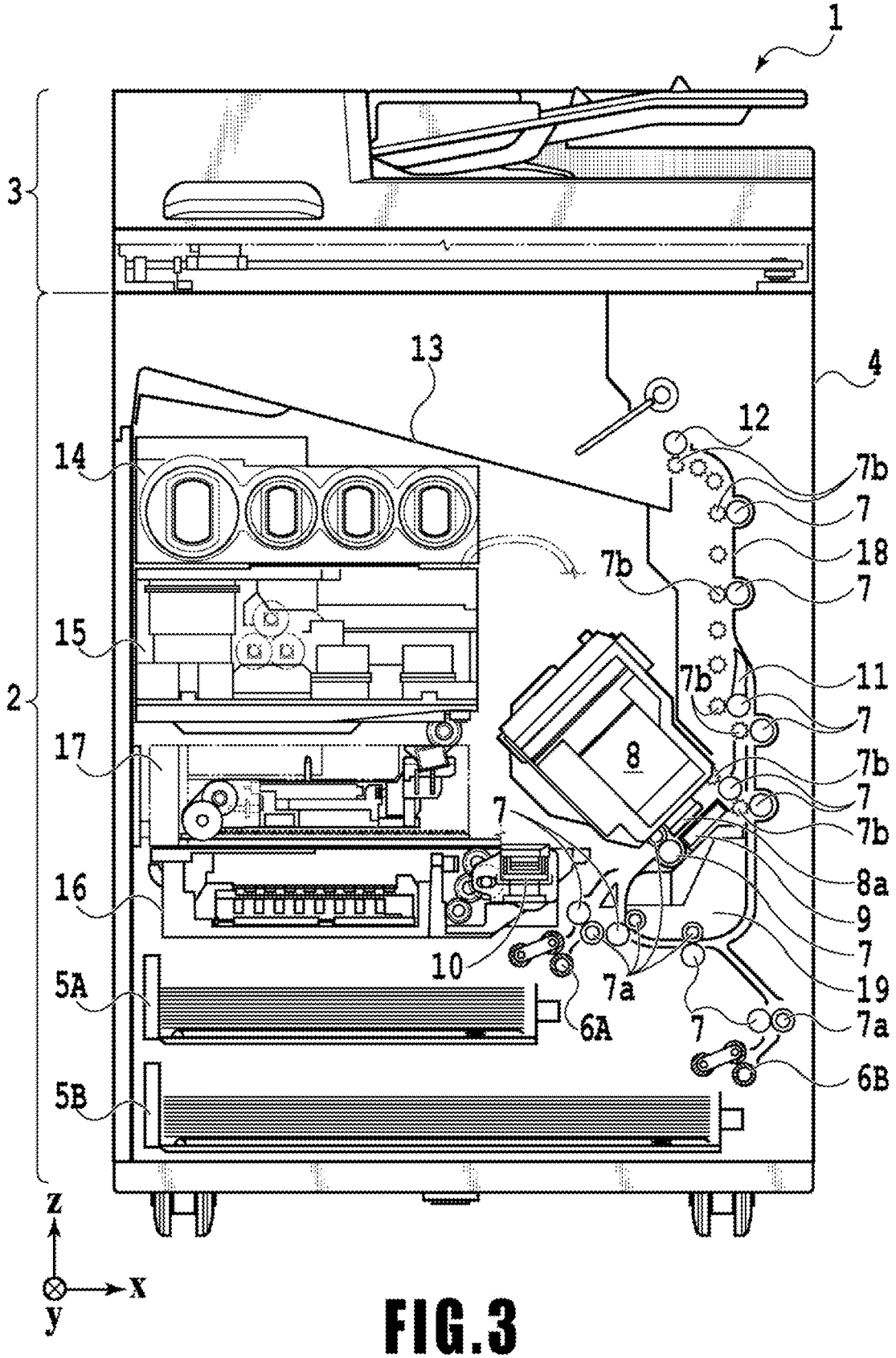
FIG. 3 shows the printing apparatus in a printing state.

FIG. 3 shows the printing apparatus 1 in a printing state. As compared with the standby state shown in FIG. 1, the cap unit 10 is separated from the ejection opening surface 8*a* of the print head 8 and the ejection opening surface 8*a* faces the platen 9. In the present embodiment, the plane of the platen 9 is inclined about 45° with respect to the horizontal plane. The ejection opening surface 8*a* of the print head 8 in a printing position is also inclined about 45° with respect to the horizontal plane so as to keep a constant distance from the platen 9.

In moving the print head 8 from the standby position shown in FIG. 1 to the printing position shown in FIG. 3, the print controller 202 uses the maintenance control unit 210 to move the cap unit 10 down to an evacuation position shown in FIG. 3, thereby separating the cap member from the ejection opening surface 8*a* of the print head 8. The print controller 202 then uses the head carriage control unit 208 to turn the print head 8 by 45° while adjusting the vertical height of the print head 8 such that the ejection opening surface 8*a* faces the platen 9. After the completion of print operation, the print controller 202 reverses the above procedure in moving the print head 8 from the printing position to the standby position.

Next, a conveying path of the print medium S in the print unit 2 will be described. Upon receipt of a print command, the print controller 202 first uses the maintenance control unit 210 and the head carriage control unit 208 to move the print head 8 to the printing position shown in FIG. 3. The print controller 202 then uses the conveyance control unit 207 to drive either the first feeding unit 6A or the second feeding unit 6B to feed the print medium S in accordance with the print command.

Figure 4C:
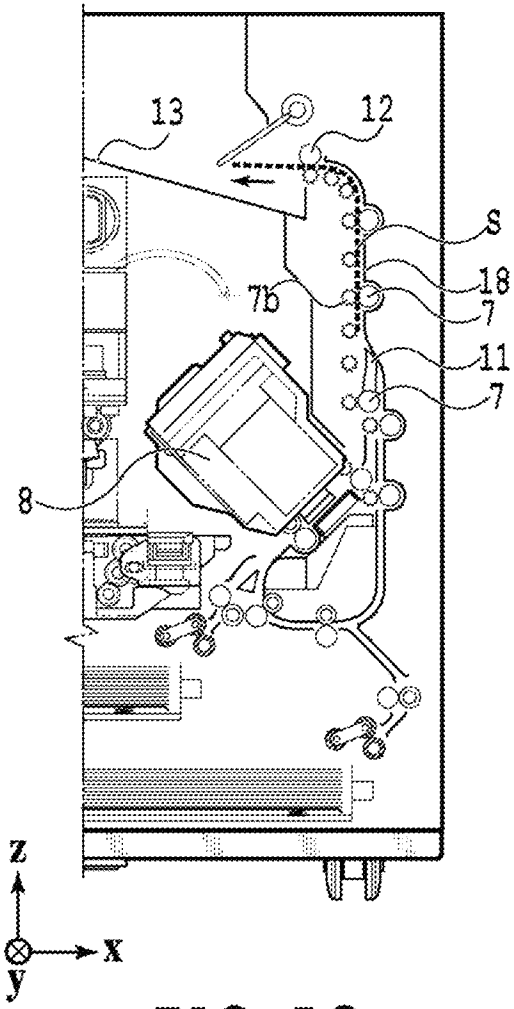
FIG. 4C shows a conveying path when a print medium is fed.
Figure 4B:
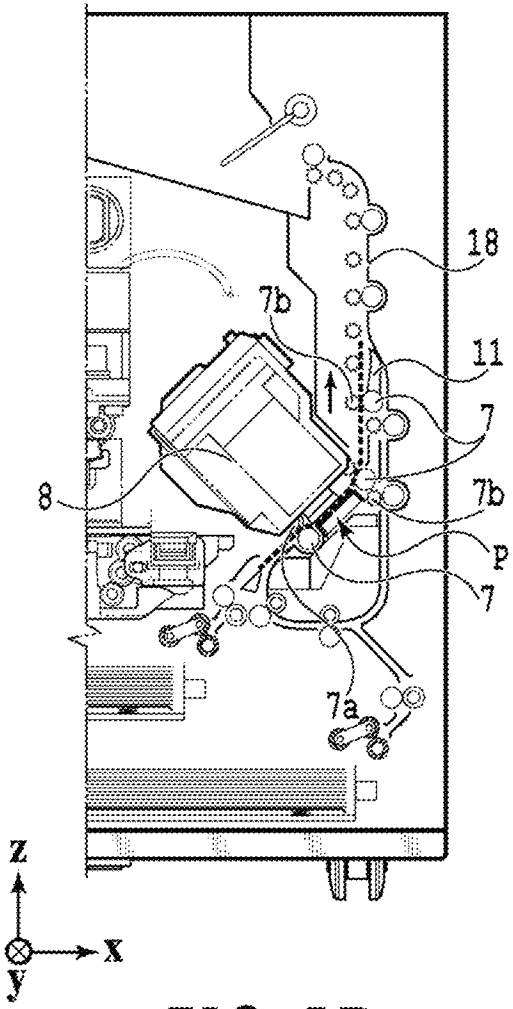
FIG. 4B shows a conveying path when a print medium is fed.
Figure 4A:
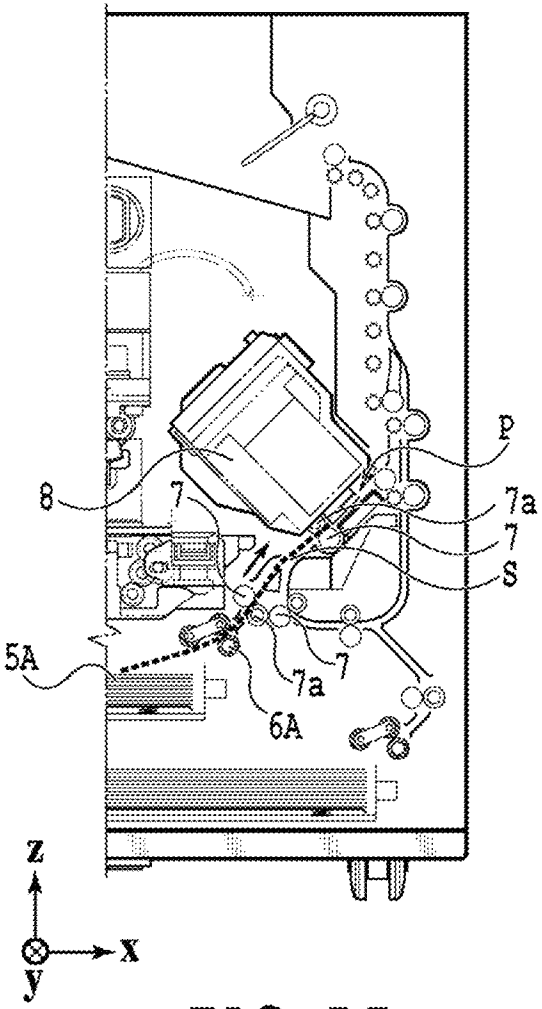
FIG. 4A shows a conveying path when a print medium is fed.

FIGS. 4A to 4C are diagrams showing a conveying path in the case of feeding an A4 size print medium S from the first cassette 5A. A print medium S at the top of a stack of printing media in the first cassette 5A is separated from the rest of the stack by the first feeding unit 6A and conveyed toward a print area P between the platen 9 and the print head 8 while being nipped between the conveying rollers 7 and the pinch rollers 7*a*. FIG. 4A shows a conveying state where the front end of the print medium S is about to reach the print area P. The direction of movement of the print medium S is changed from the horizontal direction (x-direction) to a direction inclined about 45° with respect to the horizontal direction while being fed by the first feeding unit 6A to reach the print area P.

In the print area P, a plurality of ejection openings provided in the print head 8 eject ink toward the print medium S. In an area where ink is applied to the print medium S, the back side of the print medium S is supported by the platen 9 so as to keep a constant distance between the ejection opening surface 8*a* and the print medium S. After ink is applied to the print medium S, the conveying rollers 7 and the spurs 7*b* guide the print medium S such that the print medium S passes on the left of the flapper 11 with its tip inclined to the right and is conveyed along the guide 18 in the vertically upward direction of the printing apparatus 1. FIG. 4B shows a state where the front end of the print medium S has passed through the print area P and the print medium S is being conveyed vertically upward. The conveying rollers 7 and the spurs 7*b* change the direction of movement of the print medium S from the direction inclined about 45° with respect to the horizontal direction in the print area P to the vertically upward direction.

After being conveyed vertically upward, the print medium S is discharged into the discharging tray 13 by the discharging roller 12 and the spurs 7*b*. FIG. 4C shows a state where the front end of the print medium S has passed through the discharging roller 12 and the print medium S is being discharged into the discharging tray 13. The discharged print medium S is held in the discharging tray 13 with the side on which an image was printed by the print head 8 facing downward.

Figure 5C:
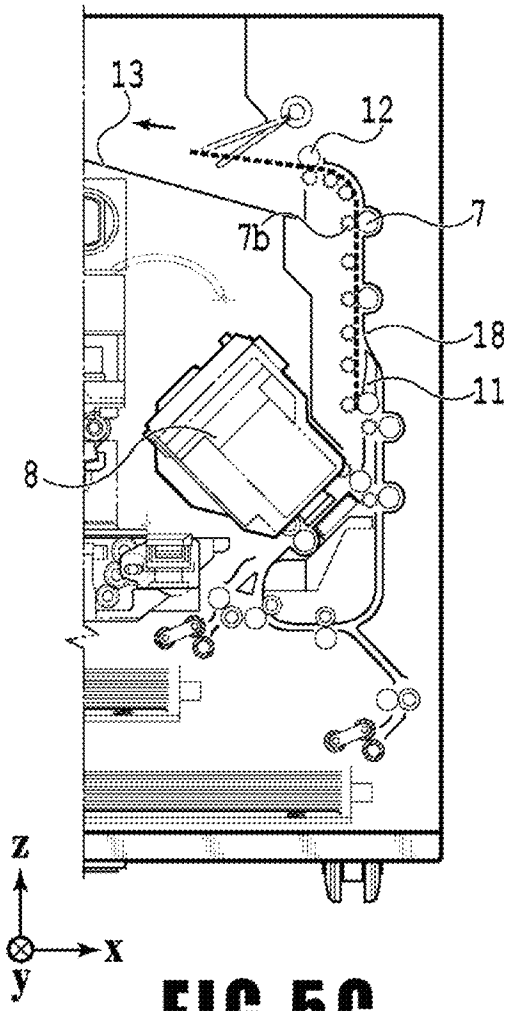
FIG. 5C shows a conveying path when a print medium is fed.
Figure 5B:
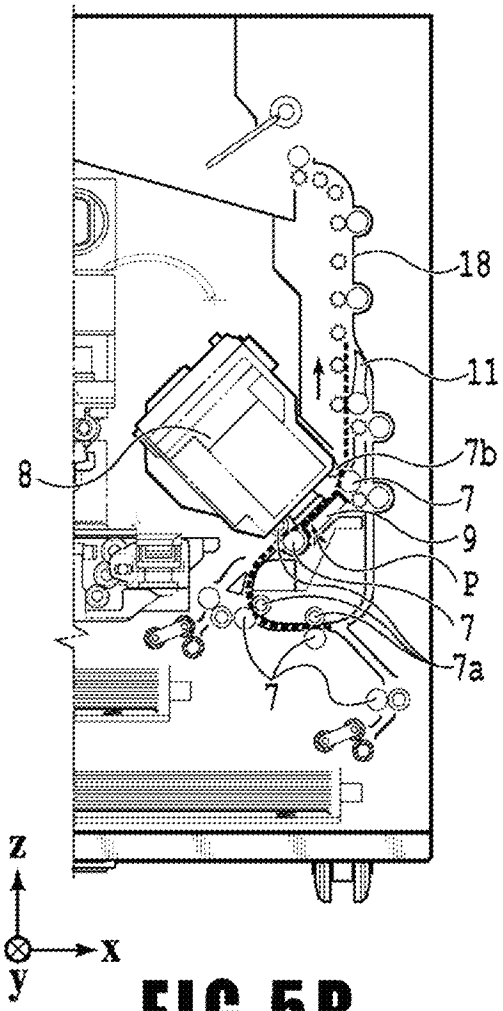
FIG. 5B shows a conveying path when a print medium is fed.
Figure 5A:
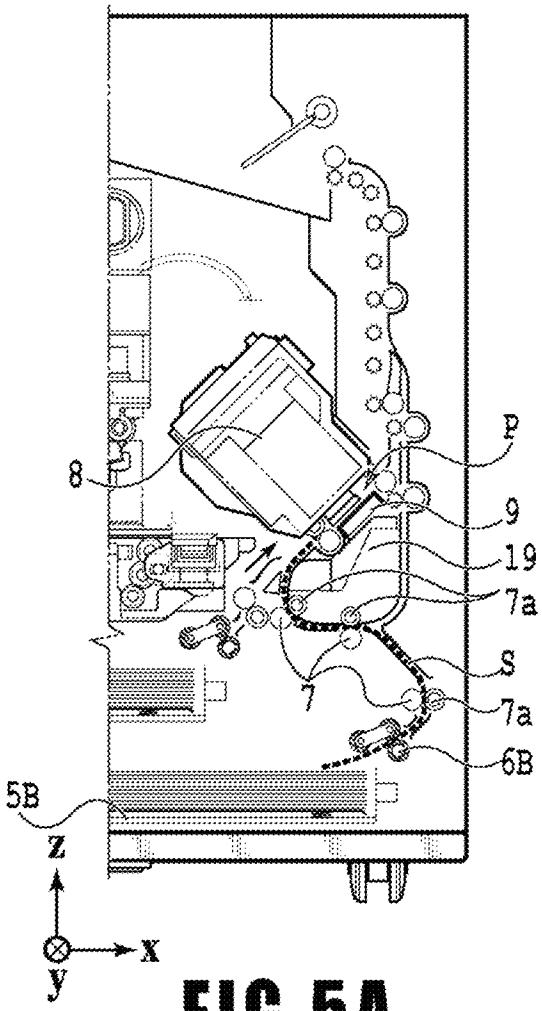
FIG. 5A shows a conveying path when a print medium is fed.

FIGS. 5A to 5C are diagrams showing a conveying path in the case of feeding an A3 size print medium S from the second cassette 5B. A print medium S at the top of a stack of printing media in the second cassette 5B is separated from the rest of the stack by the second feeding unit 6B and conveyed toward the print area P between the platen 9 and the print head 8 while being nipped between the conveying rollers 7 and the pinch rollers 7*a*.

FIG. 5A shows a conveying state where the front end of the print medium S is about to reach the print area P. In a part of the conveying path, through which the print medium S is fed by the second feeding unit 6B toward the print area P, the plurality of conveying rollers 7, the plurality of pinch rollers 7*a*, and the inner guide 19 are provided such that the print medium S is conveyed to the platen 9 while being bent into an S-shape.

The rest of the conveying path is the same as that in the case of the A4 size print medium S shown in FIGS. 4B and 4C. FIG. 5B shows a state where the front end of the print medium S has passed through the print area P and the print medium S is being conveyed vertically upward. FIG. 5C shows a state where the front end of the print medium S has passed through the discharging roller 12 and the print medium S is being discharged into the discharging tray 13.

FIGS. 6A to 6D show a conveying path in the case of performing print operation (duplex printing) for the back side (second side) of an A4 size print medium S. In the case of duplex printing, print operation is first performed for the first side (front side) and then performed for the second side (back side). A conveying procedure during print operation for the first side is the same as that shown in FIGS. 4A to 4C and therefore description will be omitted. A conveying procedure subsequent to FIG. 4C will be described below.

Figure 6D:
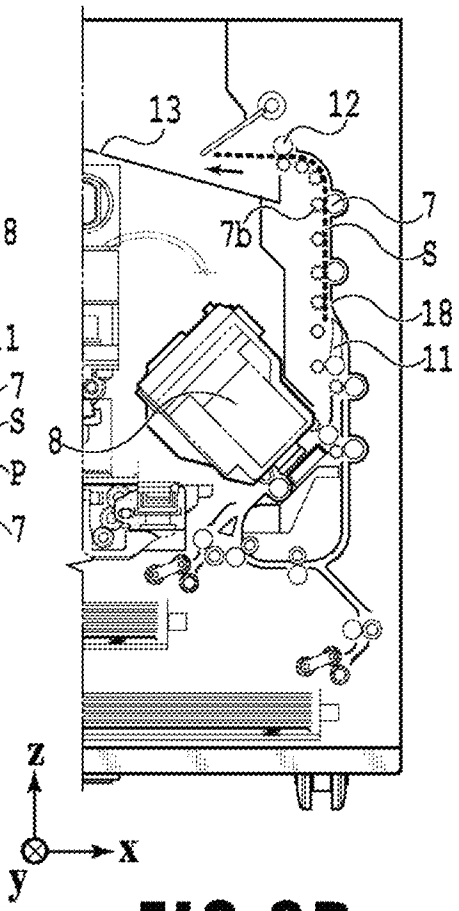
FIG. 6D shows the conveying path in performing a print operation on the back side of a print medium.
Figure 6C:
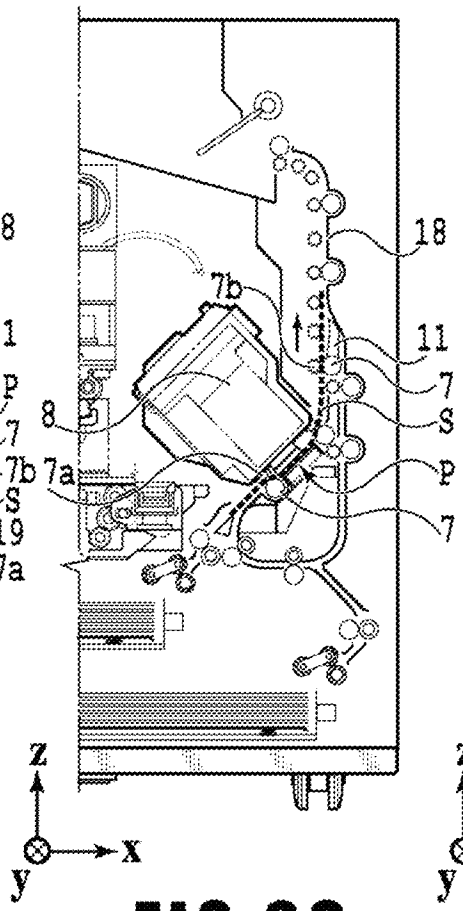
FIG. 6C shows the conveying path in performing a print operation on the back side of a print medium.
Figure 6B:
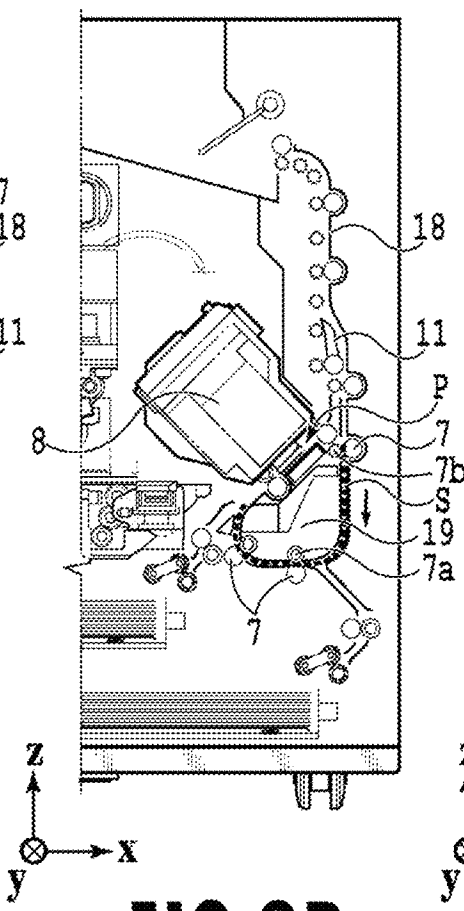
FIG. 6B shows the conveying path in performing a print operation on the back side of a print medium.
Figure 6A:
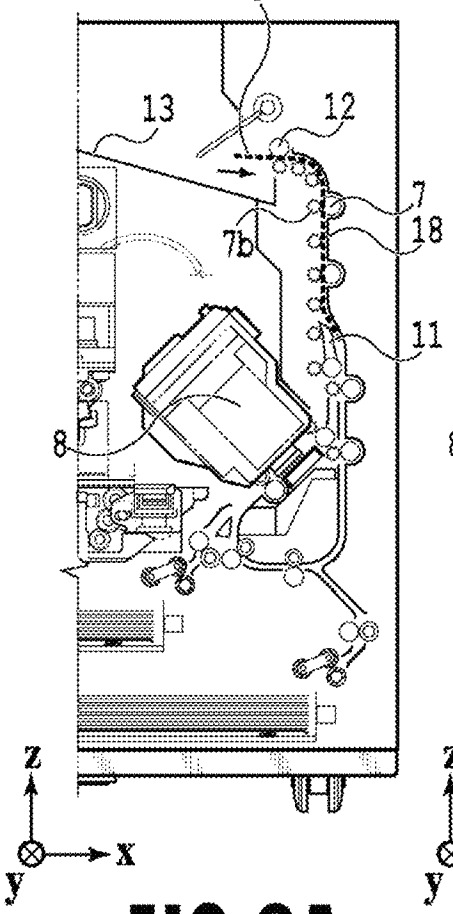
FIG. 6A shows the conveying path in performing a print operation on the back side of a print medium.

After the print head 8 finishes print operation for the first side and the back end of the print medium S passes by the flapper 11, the print controller 202 turns the conveying rollers 7 backward to convey the print medium S into the printing apparatus 1. At this time, since the flapper 11 is controlled by an actuator (not shown) such that the tip of the flapper 11 is inclined to the left, the front end of the print medium S (corresponding to the back end during the print operation for the first side) passes on the right of the flapper 11 and is conveyed vertically downward. FIG. 6A shows a state where the front end of the print medium S (corresponding to the back end during the print operation for the first side) is passing on the right of the flapper 11.

Then, the print medium S is conveyed along the curved outer surface of the inner guide 19 and then conveyed again to the print area P between the print head 8 and the platen 9. At this time, the second side of the print medium S faces the ejection opening surface 8*a* of the print head 8. FIG. 6B shows a conveying state where the front end of the print medium S is about to reach the print area P for print operation for the second side.

The rest of the conveying path is the same as that in the case of the print operation for the first side shown in FIGS. 4B and 4C. FIG. 6C shows a state where the front end of the print medium S has passed through the print area P and the print medium S is being conveyed vertically upward. At this time, the flapper 11 is controlled by the actuator (not shown) such that the tip of the flapper 11 is inclined to the right. FIG. 6D shows a state where the front end of the print medium S has passed through the discharging roller 12 and the print medium S is being discharged into the discharging tray 13.

Next, maintenance operation for the print head 8 will be described. As described with reference to FIG. 1, the maintenance unit 16 of the present embodiment comprises the cap unit 10 and the wiping unit 17 and activates them at predetermined timings to perform maintenance operation.

Figure 7:
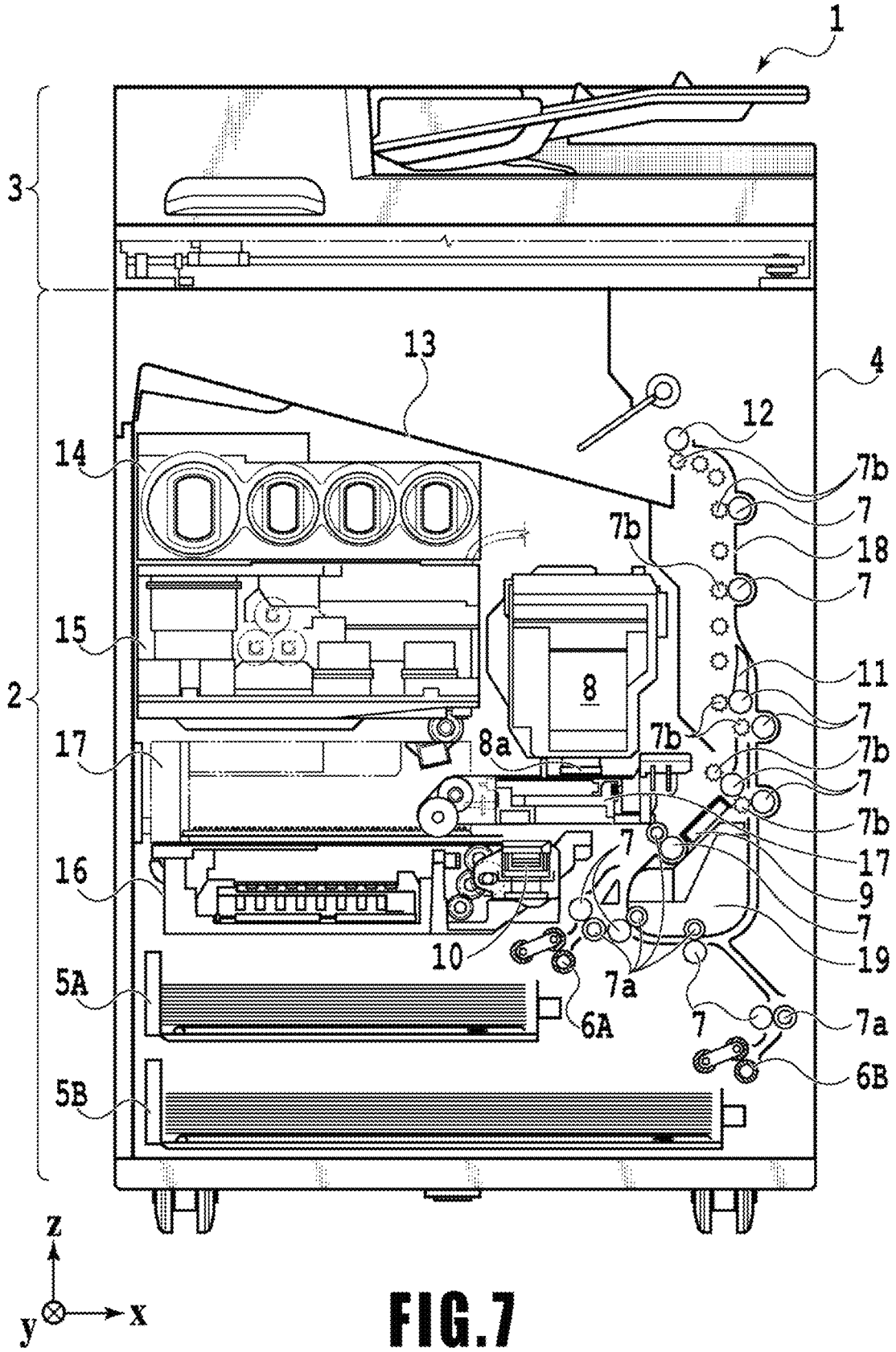
FIG. 7 shows the printing apparatus in a maintenance state.

FIG. 7 is a diagram showing the printing apparatus 1 in a maintenance state. In the case of moving the print head 8 from the standby position shown in FIG. 1 to a maintenance position shown in FIG. 7, the print controller 202 moves the print head 8 vertically upward and moves the cap unit 10 vertically downward. The print controller 202 then moves the wiping unit 17 from the evacuation position to the right in FIG. 7. After that, the print controller 202 moves the print head 8 vertically downward to the maintenance position where maintenance operation can be performed.

On the other hand, in the case of moving the print head 8 from the printing position shown in FIG. 3 to the maintenance position shown in FIG. 7, the print controller 202 moves the print head 8 vertically upward while turning it 45°. The print controller 202 then moves the wiping unit 17 from the evacuation position to the right. Following that, the print controller 202 moves the print head 8 vertically downward to the maintenance position where maintenance operation can be performed.

Hereinafter, the characteristic items of the present invention will be described.

Figure 8:
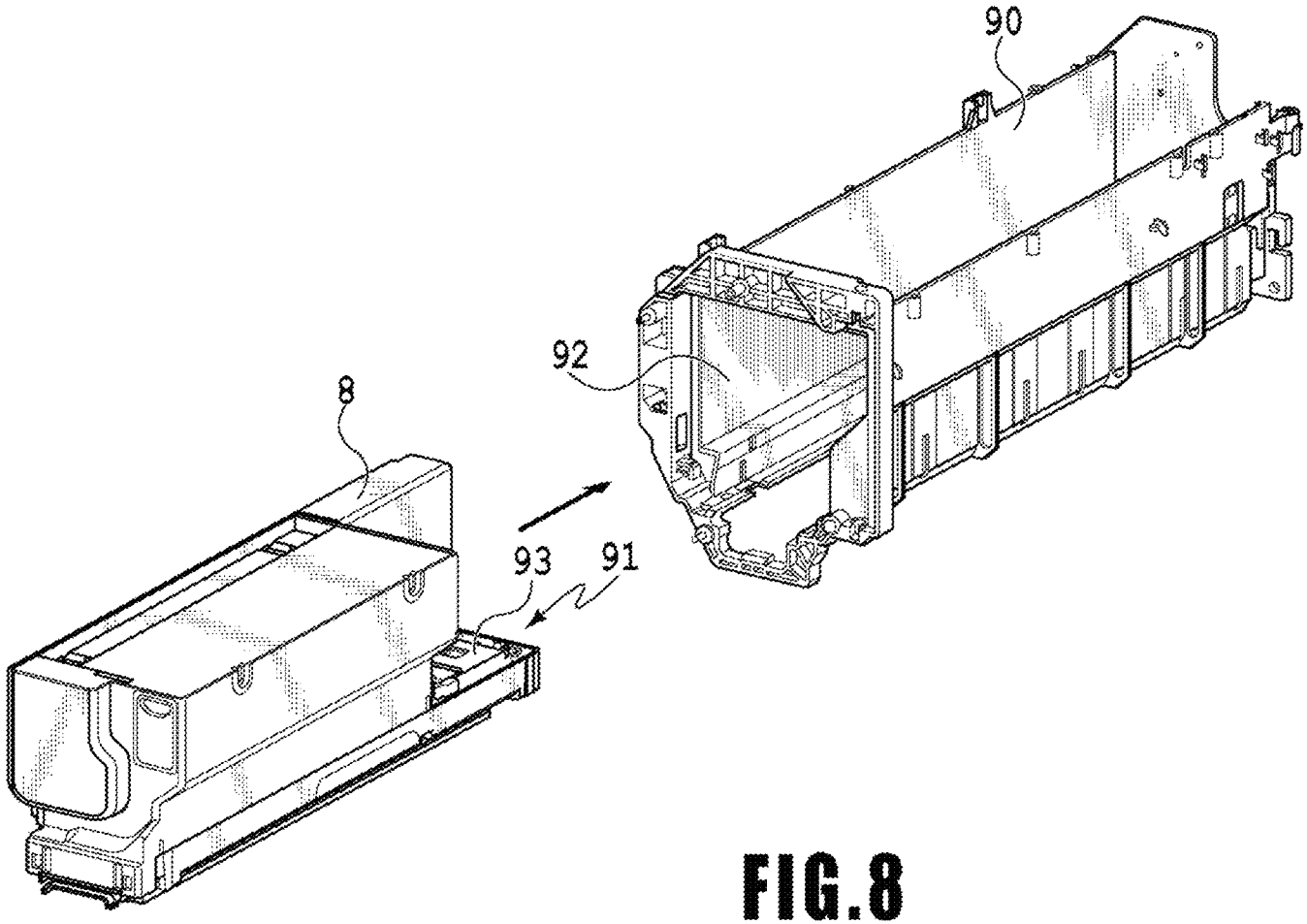
FIG. 8 is a perspective view showing a print head and head holder of the printing apparatus.

FIG. 8 is a perspective view showing the print head 8 and head holder 90 of the printing apparatus 1. The print head 8 is a circulation type print head. Here, ink is supplied to a supply port of the print head 8 through the ink supply unit 15, and passes through the print head 8 and is collected from a collection port by the ink supply unit 15. The ink supplied from the ink supply unit 15 flows through the flow path, and is supplied to the print head 8 through a joint unit 91. The print head 8 is configured to be detachable with respect to the printing apparatus 1, so is inserted into the head holder 90 by a user at the time of being mounted on the printing apparatus 1. The joint unit 91 of the print head 8 is provided on the back side in the insertion direction (at a downstream end in the insertion direction) of the print head 8. Such a configuration prevents the breakage of the joint unit 91 by a user who erroneously touches the joint unit 91 and/or the contamination to a user due to ink, at the time of exchanging the print head 8.

The head holder 90 includes an opening 92 on a side surface thereof. The print head 8 is inserted from the opening 92 at the time of mounting the print head 8 on the printing apparatus 1. Although the print head 8 of this embodiment is inclined by about 45° with respect to the horizontal direction during printing as previously described, the whole print head 8 will be inclined when the head holder 90 is inclined.

The print head 8 includes a shutter 93 in the joint unit 91. When the print head 8 is detached from the printing apparatus 1, the supply port and collection port of the print head 8 are covered (closed) with the shutter 93. The shutter 93 is capable of opening/closing the supply port and collection port of the print head 8, and is configured so as to open when the print head 8 is inserted into the head holder 90. Insertion of the print head 8 into the head holder 90 opens (exposes) the supply port and collection port of the print head 8. As described above, only when the print head 8 is mounted on the printing apparatus 1, the shutter 93 opens so that the supply port and collection port open, thereby preventing the contamination to a user due to the leakage of ink from the supply port and collection port at the time of detaching the print head 8. Moreover, at the time of detaching the print head 8, the shutter 93 is closed to prevent the careless contact by a user in the supply port and collection port, thereby the breakage of the peripherals of the supply port and collection port can be prevented.

Figure 9A:
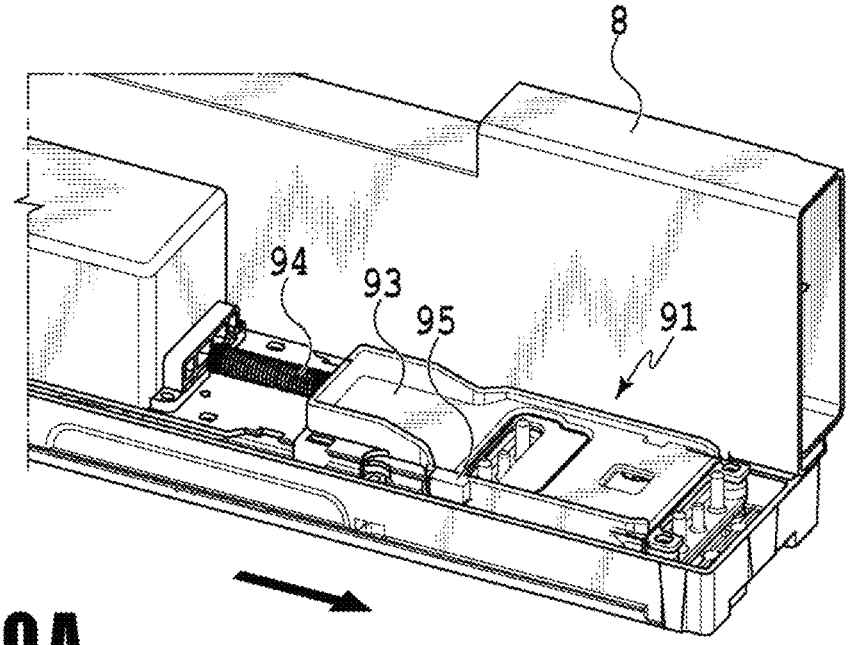
FIG. 9A shows a joint unit in a state where a shutter is closed.

FIG. 9A is a perspective view showing the joint unit 91 of the print head 8, and shows a state where the shutter 93 is closed. The shutter 93 is provided in the joint unit 91 of the print head 8 as shown. The shutter 93 is provided so as to be able to slide, and is biased by a spring 94 in the insertion direction of the print head 8 as indicated by an arrow. Moreover, the shutter 93 is biased by the spring 94 so as to maintain a state where the supply port 96 and collection port 97 are closed. Note that, in this embodiment an example using the spring 94 as a member for biasing the shutter 93 has been described, but not limited thereto, and this member may be an elastic member, etc.

A hook (protrusion) 95 which protrudes in a direction crossing the insertion direction of the print head 8 is provided in the shutter 93. Once the print head 8 is inserted into the head holder 90, then a non-shown guide projection provided in the holder 90 and the hook 95 abut each other to generate a force against the bias of the spring 94. Then, the print head 8 is further pressed down, so that the shutter 93 is relatively displaced (slides) with respect to the print head 8, resulting in an open state. That is, the print head 8 is continued to be inserted while the guide projection of the head holder 90 and the hook 95 remain abutted against each other, so that the shutter 93 is displaced against the bias of the spring 94 to expose the supply port 96 and collection port 97. In this manner, the shutter 93 is configured so as to be able to simultaneously open or close both the supply port 96 and collection port 97.

Figure 9B:
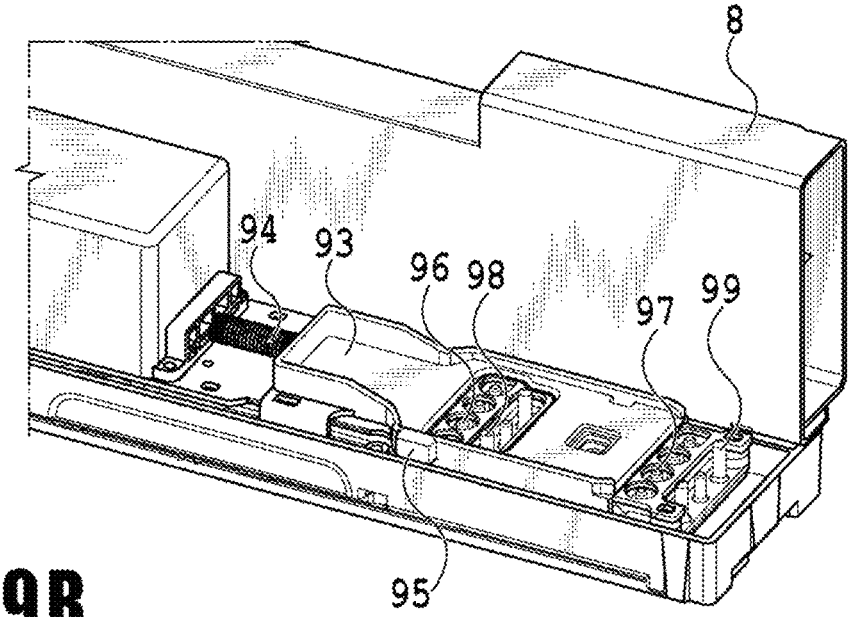
FIG. 9B shows a joint unit in a state where a shutter is opened.

FIG. 9B is a perspective view showing the joint unit 91 of the print head 8, and shows a state where the shutter 93 is opened. Once the print head 8 is inserted into the head holder 90 (here, the head holder 90 is omitted), then as shown the shutter 93 opens so that the supply port 96 and collection port 97 of the needle open. The supply port 96 opens inside the opening provided in the shutter 93. Since the printing apparatus 1 prints using four colors of ink, the supply port 96 and collection port 97 include four openings corresponding to four colors, respectively. Note that the number of the openings is not limited to four.

As described above, when the print head 8 is detached from the printing apparatus 1, the opening on the supply side and the opening on the collection side are closed with the shutter 93, so that contamination to a user due to ink at the time of exchanging the print head 8 can be prevented Near the supply port 96 and collection port 97, rod-like positioning pins (guide members) 98, 99 are provided, respectively, so as to be able to guide the position of the supply port 96 and the position of the collection port 97 in a state where the shutter 93 is closed. By the positioning pins 98, 99, joints 110, 120 (see FIG. 10 described later) to be connected to the supply port 96 and collection port 97 (to needles with the supply port 96 and needles including the collection port 97) are positioned. The positioning pins 98, 99 are configured to be always exposed both in a state where the shutter 93 is closed and in a state where it is opened. The positioning pins 98, 99 are longer than each of the needles, and the front ends of the positioning pins 98, 99 protrude from the shutter 93 even in a state where the shutter 93 is closed. Moreover, at the front ends of the positioning pins 98, 99, a taper is provided, respectively, and is configured so as to guide a positioning opening of a joint to be connected and position the same at an appropriate position. In this embodiment, two positioning pins 98, 99 are provided on the supply side and on the collection side, respectively, but not limited thereto. That is, the number of positioning pins provided on the supply side and the number of positioning pins provided on the collection side may be singular or may be plural.

Figure 10:
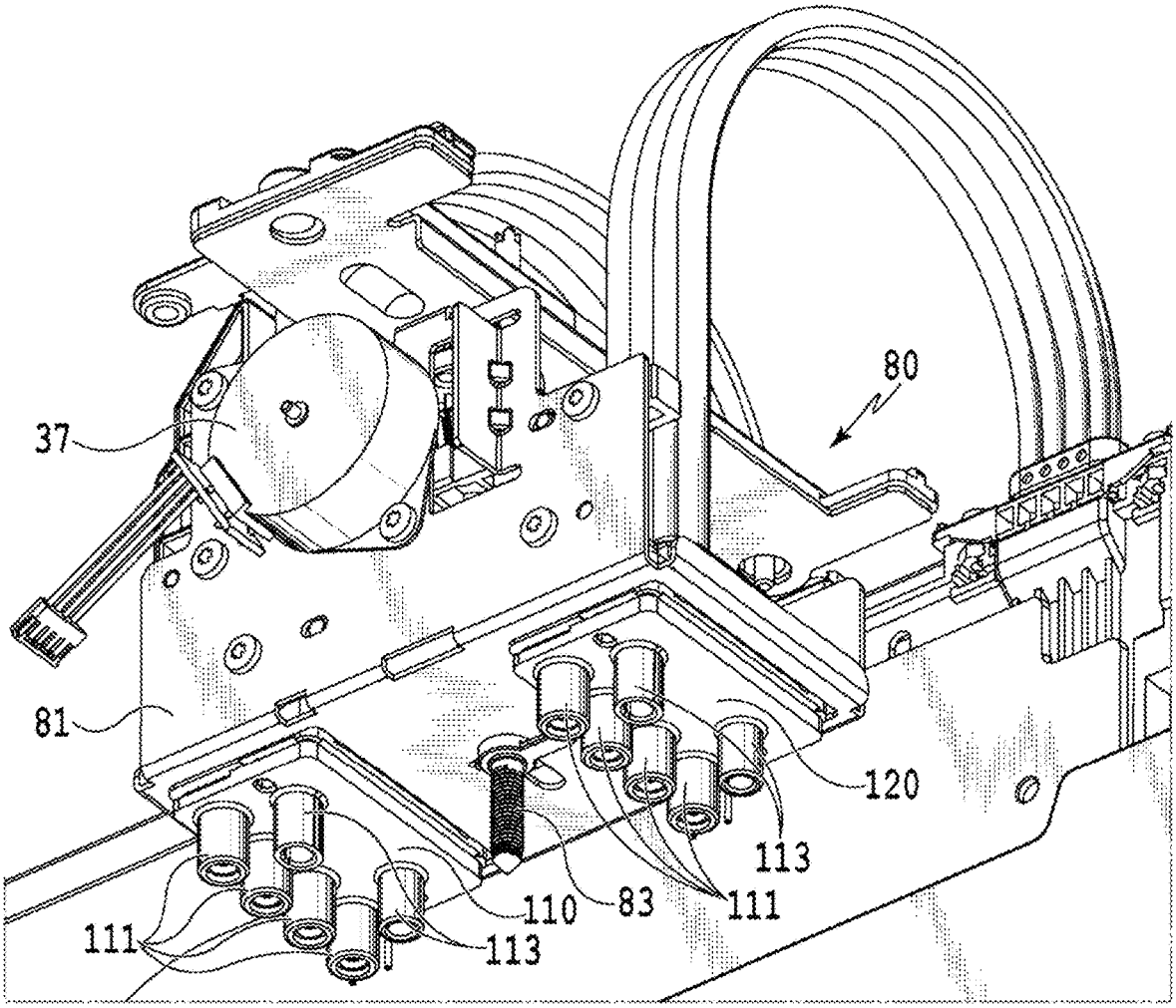
FIG. 10 is a perspective view showing the joint unit of the printing apparatus.

FIG. 10 is a perspective view showing a joint unit 80 of the printing apparatus 1. The joint unit 80 is capable of connecting to the print head 8, and the ink supply unit 15 and print head 8 are connected via the joint unit 80. The joint unit 80 includes a first joint member 110 for supplying ink to the print head 8 and a second joint member 120 for collecting ink from the print head 8. As described above, in this embodiment, one joint unit is configured to be able to supply ink to the print head 8 and collect ink from the print head 8.

The joint unit 80 includes a joint holder 81 which supports the first joint member 110 and the second joint member 120, and includes an ascending/descending device 83 between the first joint member 110 and the second joint member 120. The ascending/descending device 83 is an axial member on which a male screw is formed, and is rotatably connected to a motor 37. Rotating the ascending/descending device 83 allows the joint unit 80 to ascend/descend, and changing the rotation direction allows ascending and descending to be switched. When the joint unit 80 descends due to the rotation of the ascending/descending device 83, the joint unit 80 is connected to the print head 8, while when the joint unit 80 ascends, the joint unit 80 is disconnected from the print head 8

Because the first joint member 110 and the second joint member 120 have an identical configuration, hereinafter the first joint member 110 will be described as an example. The printing apparatus 1 prints using four colors of ink. Therefore, the first joint member 110 includes four joint openings 111 each corresponding to each of four colors. Note that the number of these joint openings 111 is not limited, but may be singular or may be plural. In four joint openings 111, the other end opposite to the one opened end is connected to the ink supply unit 15 via a tube, and is arranged in one row, and the one end is opened toward the descending direction along which the joint unit 80 descends. Moreover, the first joint member 110 includes two positioning openings 113, and two positioning openings 113 are provided so as to be abreast of a row of joint openings 111. Note that the number of these positioning openings is not limited, but may be singular or may be plural.

The first joint member 110 and the second joint member 120 are respectively provided at both ends of the joint holder 81, and the ascending/descending device 83 is provided between the first joint member 110 and the second joint member 120 and approximately at the center thereof. As described above, the first joint member 110 and the second joint member 120 are provided so as to be bilaterally-symmetric with respect to the ascending/descending device 83 (be at substantially the same distance from the ascending/descending device 83). Thus, when the joint unit 80 is connected to the print head 8 due to descending of the ascending/descending device 83, a force is substantially equally applied to the first joint member 110 and the second joint member 120, respectively, allowing for sufficient connection.

Figure 11:
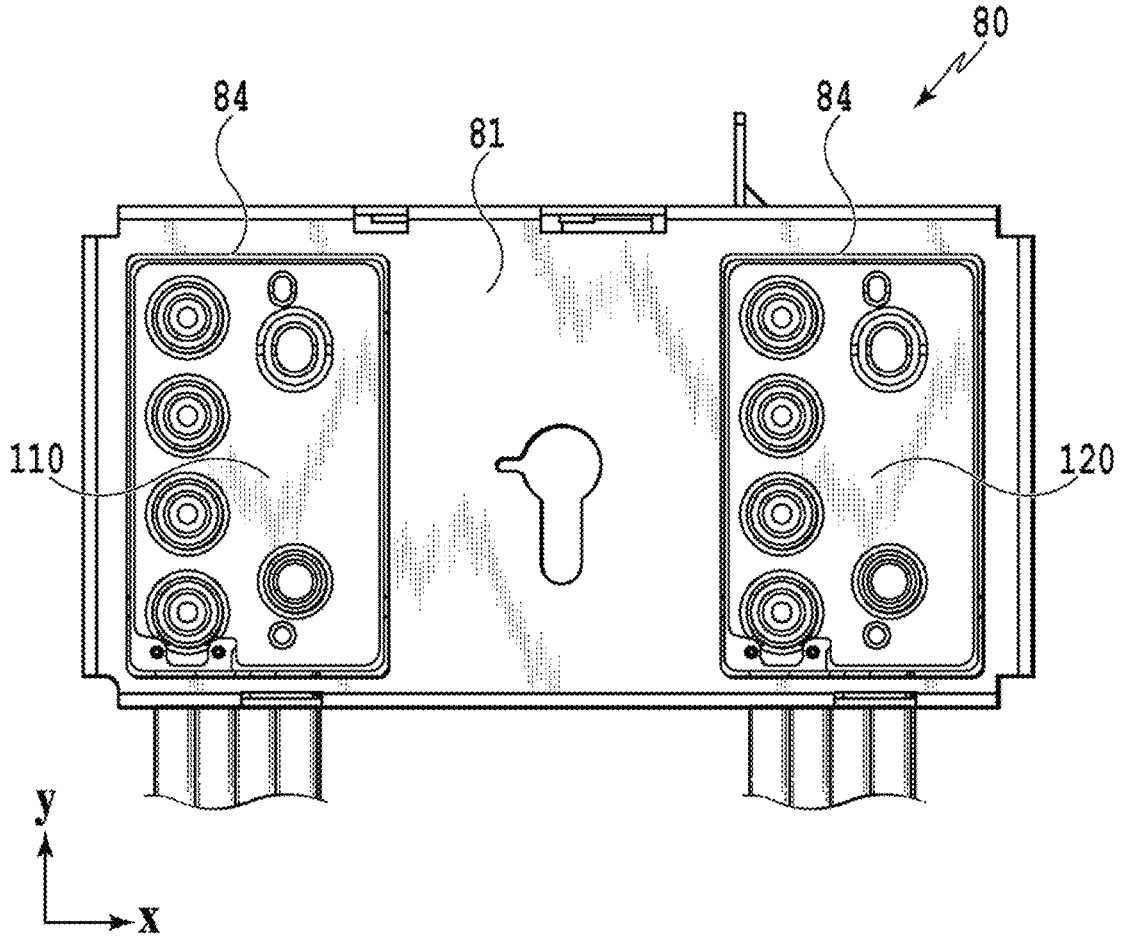
FIG. 11 shows the joint unit seen from the print head side.

FIG. 11 shows the joint unit 80 seen from the print head 8 side. In the joint holder 81, there are provided two openings 84; one for receiving the first joint member 110 and the other for receiving the second joint member 120. The opening 84 is larger than the outside diameter size of each of the first joint member 110 and the second joint member 120. That is, two openings 84 are configured so that once two openings 84 respectively receive the first joint member 110 and the second joint member 120, a predetermined amount of space is formed between the first joint member 110 and the opening 84 and between the second joint member 120 and the opening 84, respectively. Therefore, the first joint member 110 and the second joint member 120 are configured so as to be able to move with respect to the joint holder 81.

Note that, preferably this predetermined amount of space is appropriately set according to the configuration of the apparatus. Such configuring allows the first joint member 110 and the second joint member 120 to move in an arrow X direction and in an arrow Y direction when the first joint member 110 and the second joint member 120 connect to the print head 8, and allows for connection with a high degree of freedom in the arrow X direction and in the arrow Y direction. That is, both the first joint member 110 and the second joint member 120 are capable of connecting to the print head 8 with a high degree of freedom during connection.

That is, even if there is any offset due to a variation in mounting position or due to component tolerances between the first joint member 110 and the connection unit of the print head 8 and between the second joint member 120 and the connection unit of the print head 8, the offset can be absorbed by providing a predetermined amount of space. This allows the first joint member 110 and the second joint member 120 to be connected to the print head 8 in a satisfactory connection state. In particular, in the printing apparatus 1, ink is pressed and supplied by a non-shown pump from an ink storing unit (liquid storing unit) inside the ink supply unit 15 to the print head 8, so a connection state more reliable than a supplying form utilizing a difference in head of ink is required. Therefore, a plurality of joint members configured to be able to move with respect to the joint holder 81 allows each of the plurality of joint members to be equalized in terms of offset at the time of connection, and allows a more accurate connection state to be realized.

The joint unit 80 is connected to one end of the print head 8. The print head 8 is configured to be able to be exchanged by a user, and is exchanged by manipulating the other end of the print head 8 in exchanging the print head 8. That is, the print head 8 and the joint unit 80 are configured to be connected at an end on the back side in the insertion direction in inserting the print head 8 into the printing apparatus 1.

As described above, the connection unit between the print head 8 and the joint unit 80 is distant from an operation unit (not shown) of the print head 8 for a user to manipulate, so that contamination to a user's hand due to ink at the time of exchanging the print head 8 by a user is prevented. Moreover, breakage of the joint unit by a user who erroneously touches the joint unit can be prevented.

Note that, in this embodiment, a configuration using two joint members, i.e., the first joint member 110 and the second joint member 120, has been described, but not limited thereto. That is, a plurality of joint members may be used which are arranged surrounding the ascending/descending device so that a force is substantially equally applied to each joint member at the time of connection.

FIG. 12A to FIG. 12D show in stages how the print head 8 is inserted into the printing apparatus 1 and the joint opening 111 of the first joint member 110 and the needle 112 provided in the supply port 96 and collection port 97 of the joint unit 91 are connected. Because the first joint member 110 and the second joint member 120 perform similar operation at the time of connection, only the first joint member 110 will be described here.

Figure 12A:
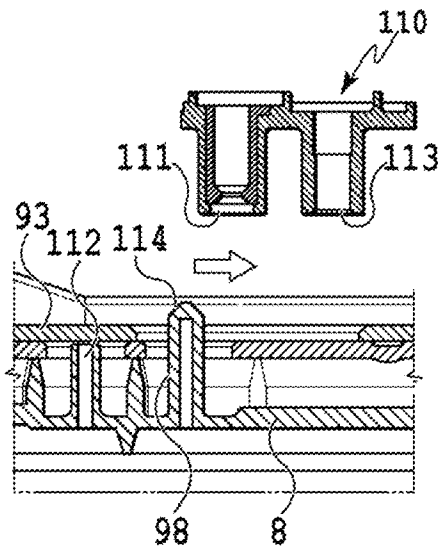
FIG. 12A shows in stages how a joint opening and a needle are connected.
Figure 12B:
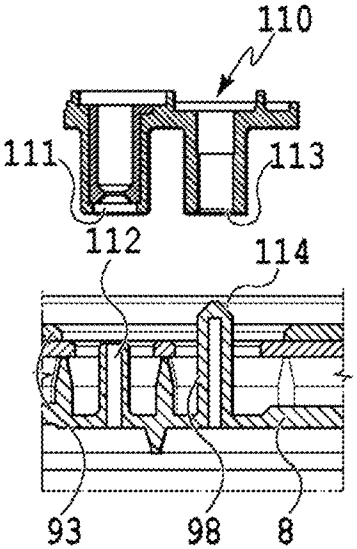
FIG. 12B shows in stages how a joint opening and a needle are connected.
Figure 12C:
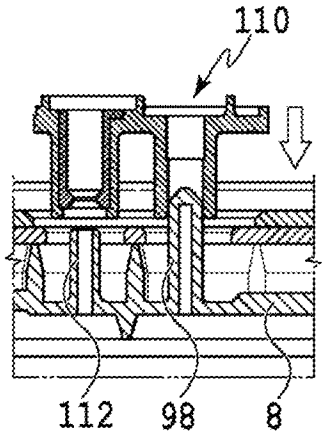
FIG. 12C shows in stages how a joint opening and a needle are connected.

First, once the print head 8 is inserted into the printing apparatus 1 along an arrow as shown in FIG. 12A, then a non-shown guide projection provided in the head holder 90 abuts against the hook 95 (see FIG. 9A) to generate force against the bias of the spring 94 (see FIG. 9A). At this stage, the shutter 93 is still closed. Thereafter, when the print head 8 is further pressed down, the print head 8 settles at a predetermined position and the shutter 93 slides in a direction opposite to the arrow shown in FIG. 12A, so that the shutter 93 is opened (see FIG. 12B). The length of the positioning pin 98 is longer than the length of the needle 112. Therefore, at the time of connecting to the joint 110, fitting between the positioning pin 98 and the positioning opening 113 of the joint 110 is performed earlier than fitting between the joint opening 111 and the needle 112 (see FIG. 12C). In this case, since a taper 114 is provided at a front end of the positioning pin 98, the positioning opening 113 of the joint 110 is guided by the taper 114 of the positioning pin 98 and fitted at an appropriate position.

Figure 12D:
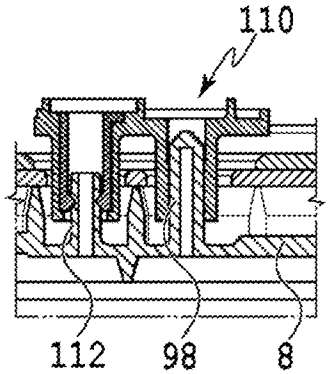
FIG. 12D shows in stages how a joint opening and a needle are connected.

After the positioning opening 113 and the positioning pin 98 are fitted together, the joint opening 111 and the needle 112 are fitted together (see FIG. 12D). In this case, because the position of the joint 110 is already at an appropriate position due to the fitting between the positioning opening 113 and the positioning pin 98, accurate fitting between the joint opening 111 and the needle 112 can be performed. Such accurate fitting can prevent ink leakage from the fitted unit.

As described above, the positioning pin 98 longer than the needle 112 is provided in the joint unit 91 of the print head 8, and the joint unit 91 includes the shutter 93 which closes the opening on the supply side and the opening on the collection side when the print head 8 is detached. Thus, a print head which suppresses contamination due to ink at the time of being mounted on a printing apparatus and/or after being detached from the printing apparatus, and a printing apparatus which prints using the print head can be realized.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-065463 and No. 2018-065475, filed Mar. 29, 2018, which are hereby incorporated by reference herein in their entirety.

What is claimed is:

1. A printing apparatus comprising:

a print head configured to print by ejecting liquid;

a storing unit configured to store liquid to be supplied to the print head;

a joint unit configured to connect the storing unit and the print head; and a holder unit configured to be moved in a height direction relative to the print head by a driving source and hold the joint unit, wherein the holder unit includes a movement unit provided on a side connected to the print head and configured to rotate by the driving source and move the holder unit with respect to the print head.

2. The printing apparatus according to claim 1, wherein the joint unit includes a joint opening for supplying liquid from the storing unit to the print head.

3. The printing apparatus according to claim 2, wherein liquid is supplied from the storing unit to the print head under pressure.

4. The printing apparatus according to claim 2, wherein the print head includes a supply port which is connected to the joint unit and a guide member for positioning the joint opening and the supply port.

5. The printing apparatus according to claim 4, wherein the guide member is longer than the supply port.

6. The printing apparatus according to claim 1, wherein the joint unit includes a positioning member for positioning the joint unit with respect to the print head.

7. The printing apparatus according to claim 1, wherein the print head is detachably inserted into the printing apparatus along an insertion direction, and wherein a connection between the print head and the joint unit is made at a downstream side with respect to the insertion direction.

8. The printing apparatus according to claim 1, wherein the print head is of a full-line type having a plurality of ejection ports configured to eject liquid and arranged in a direction corresponding to a width of a print medium.

9. The printing apparatus according to claim 1, wherein the joint unit includes:

a first joint unit configured to connect the storing unit and the print head for supplying liquid from the storing unit to the print head; and a second joint unit configured to connect the storing unit and the print head for collecting liquid from the print head, and wherein both of the first joint unit and the second joint unit are connected to a downstream side of the print head with respect to the insertion direction.

10. The printing apparatus according to claim 9, wherein the print head is of a full-line type having a plurality of ejection ports configured to eject liquid and arranged in a direction corresponding to a width of a print medium.

11. The printing apparatus according to claim 1, wherein the print head is held to be inclined with respect to a horizontal direction when in a printing position.

* * * * *